United States Patent [19]

Noren

[11] Patent Number: 4,638,854

[45] Date of Patent: Jan. 27, 1987

[54] HEAT PIPE ASSEMBLY

[76] Inventor: Don W. Noren, 846 Blandford Blvd., Redwood City, Calif. 94062

[21] Appl. No.: 504,527

[22] Filed: Jun. 15, 1983

[51] Int. Cl.[4] ..... F28D 15/00; F28F 1/30

[52] U.S. Cl. ..... 165/76; 165/47; 165/96; 165/182; 425/425; 425/435; 425/DIG. 110

[58] Field of Search ..... 165/181, 182, 186, 76, 165/47, 96

[56] References Cited

U.S. PATENT DOCUMENTS

| | | | |
|---|---|---|---|
| 898,107 | 9/1908 | Hill | 165/181 |
| 987,361 | 3/1911 | Hasburg . | |
| 1,673,569 | 6/1928 | Kubler . | |
| 2,751,528 | 6/1956 | Burton | 165/185 |
| 3,277,957 | 10/1966 | New et al. | 165/182 |
| 3,884,293 | 5/1975 | Pessolano . | |
| 4,036,286 | 7/1977 | Anderson et al. | 165/181 |
| 4,131,785 | 12/1978 | Shutt . | |

FOREIGN PATENT DOCUMENTS

| | | | |
|---|---|---|---|
| 1206000 | 8/1959 | France | 165/181 |
| 957 | 1/1981 | Japan | 126/433 |
| 31765 | 2/1982 | Japan | 126/433 |

*Primary Examiner*—Albert W. Davis, Jr.

*Attorney, Agent, or Firm*—Fay, Sharpe, Fagan, Minnich & McKee

[57] ABSTRACT

Means for accurately controlling the transfer of heat to or from a device includes a heat pipe having a condenser end and an evaporator end. A helical screw thread is provided on the exterior surface of the heat pipe so that a portion of the heat pipe may be removably insertable via the threading into a threaded aperture in a desired section of the device. Alternatively, a connecting member, in which a portion of the heat pipe is fixed, may be selectively secured to the desired section of the device. At least one heat sink fin which is selectively securable on the heat pipe via the threading may also be provided.

16 Claims, 7 Drawing Figures

HEAT PIPE ASSEMBLY

BACKGROUND AND SUMMARY OF THE PRESENT INVENTION

The present invention relates generally to heat pipes. More specifically, the present invention relates to a heat pipe which can be secured to a device by securing means and to which heat sink means can be selectively added to accurately control the amount of heat transferred.

A conventional heat pipe is a miniaturized, hermeticallly sealed evaporating and condensing system which functions to effect an axial transfer of thermal energy. The conventional heat pipe includes a sealed elongated container, preferably made of a heat conductive metal such as copper or aluminum, a capillary wick structure which is circumferentially secured to the interior surface of the container, and a quantity of working fluid such as mercury sufficient to at least partially saturate the wick structure. After the working fluid has been added to the system, the container is sealed while under a vacuum.

Since the container is sealed under a vacuum, the working fluid is in equilibrium with its own vapor. Thus, any application of heat to any external surface of the pipe will cause an instantaneous evaporation of working fluid near the heated surface. Heat transfer via heat pipe is highly efficient since the quantity of heat absorbed in the vaporization of a fluid is enormous compared to that absorbed during an increase of temperature of a liquid.

The vapor generated as a result of a heat addition creates a pressure gradient within the heat pipe which forces the vapor to an area of the heat pipe having a lower pressure and temperature. The lower temperature causes condensation of the vapor, thereby allowing the latent heat of vaporization to be dissipated into the condenser surfaces of the heat pipe. Heat may be removed from the condenser surfaces by conduction, convection or radiation into the surrounding environment.

After condensation, the condensed working fluid is returned to the evaporator region (i.e., where heat is added) by capillary pumping forces within the circumferential interior wick structure. This return may occur either with or without the aid of gravity.

Such conventional heat pipes have been used to transfer heat in many different applications. For example, one known heat pipe, which has a finned heat sink joined to a condenser end, is used to transfer heat from an internal combustion engine. Another known heat pipe is used to transfer heat from a modular, removable electrical heat-producing unit into a liquid containing storage chamber. It would be useful, however, to provide a heat pipe of which a portion could be selectively secured to a device by securing means and to which heat pipe a selected number of heat transferring surfaces could be selectively secured to accurately control the heat transfer process. Such a heat pipe could be used, for example, to transfer heat to selected parts of a conventional roto-mold to cause such parts to increase in temperature at the same rate as the general mold or even at a higher rate.

In general, rotational molding or roto-molding, is a method of making hollow plastic parts such as vehicle bumpers, toys, car head rests, water tanks, etc. In roto-molding, the parts are formed from a fine thermoplastic polymer powder (or liquid in some instances) within a closed metal mold which is first rotated in a heating chamber to melt the powder and then in a cooling chamber to solidify the part. Because of the rotation, the plastic powder covers all the interior surfaces of the mold. While the mold is rotating, it is placed inside a hot air oven so that as the mold heats up the plastic powder begins to stick to the inside of the mold and melts to form the desired shape. When the melted plastic has completely coated the mold inside surface, it is moved out of the oven and cooled by a medium such as air or water. After the mold has been cooled, it can be opened and the part removed.

The thickness of the plastic part produced in the roto-mold depends upon how fast each part of the mold surface heats up. If any mold surface heats up more slowly than the rest of the mold, that surface receives less plastic build-up and therefore a thinner plastic wall which makes for undesirable strength variations in the plastic part. It would therefore be desirable to provide a method and a means for transferring additional heat to selected parts of such a roto-mold and of accurately controlling the rate of such transfer.

It would also be useful to provide a means for withdrawing heat from selected portions of a device such as, for example, an electronic component structure. Such means could comprise a heat pipe a portion of which should preferably be easily securable to a hot portion of an electronic device to cool the electronic device. Easy securing of the heat pipe to the electronic device prevents the need for close tolerances or the necessity for having custom designed heat pipes for each specific electronic unit.

Accordingly, a means for accurately controlling the transfer of heat according to the present invention includes a heat pipe having a condenser end and an evaporator end with one of the ends being removably securable by securing means to a desired section of the device meant to be heated or cooled. A heat sink means, which is selectively positionable on the heat pipe and securable thereon by mounting means is also provided to enable additional heat to be transferred by the heat pipe.

BRIEF DESCRIPTION OF THE DRAWINGS

The invention may take form in certain parts and arrangements of parts, preferred embodiments of which will be described in detail in the specification, and wherein.

DESCRIPTION OF THE PREFERRED EMBODIMENTS

Figure 1:
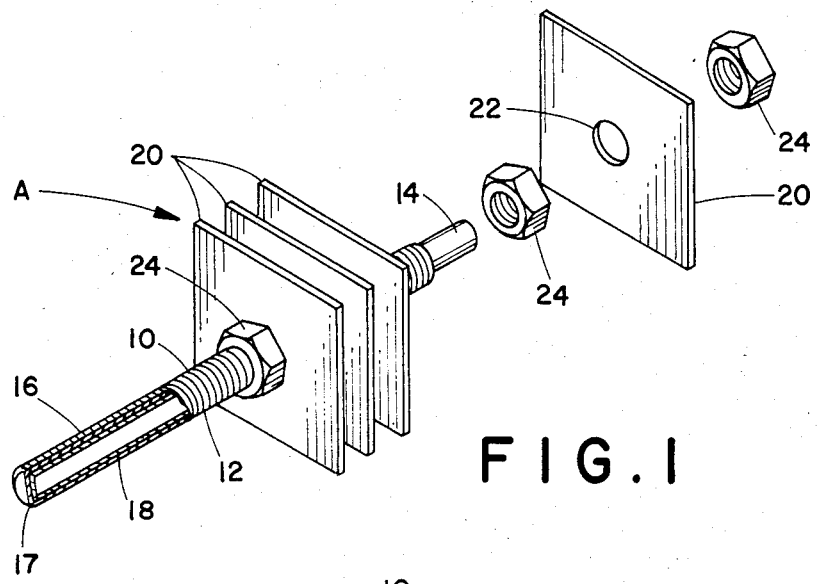
FIG. 1 is a partially exploded perspective view, partly in cross section, of a heat pipe assembly according to the present invention.

With reference to the drawings, wherein the showings are for purposes of illustrating preferred embodiments of the invention only and not for purposes of limiting the same, FIG. 1 shows a heat pipe assembly A including a heat pipe 10 which is provided with an exterior helical threading 12. The threading 12 may extend the entire axial length of the heat pipe 10 or could be absent along one length of the heat pipe, as is illustrated. The heat pipe 10 has a condenser end 14 and an evaporator end 16. Heat transfer can take place in either direction in the heat pipe 10 but always towards the cooler end, termed the condenser end 14, of the pipe. Comprising the heat pipe 10 is an exterior shell 17 which is covered on its interior surface with a capillary wick structure 18. A fluid in the heat pipe 10 vaporizes as heat is applied to the evaporator end 16 and travels to the condenser end 14 where it gives up its latent heat and condenses. The condensed fluid travels by capillary action along the wick 18 back to the evaporator end 16.

The assembly A also includes a plurality of fins 20 each having a central aperture 22 so that they may be mounted onto the heat pipe 10 to enhance its heat transfer capabilities. Mounting means are also provided to mount the fins 20 on the heat pipe 10. Such mounting means could include a nut 24 provided between each fin 20 to secure the fins in position. Alternatively, the mounting means could include a threaded portion on each fin 20 (not illustrated) or any other conventional way of detachably securing a fin to a pipe.

Since the heat pipe 10 is threaded, the number of heating fins 20 may be easily changed so that the amount of heat transferred by the heat pipe can be precisely controlled. Preferably, one nut 24 is positioned between every two fins 20.

Figure 2:
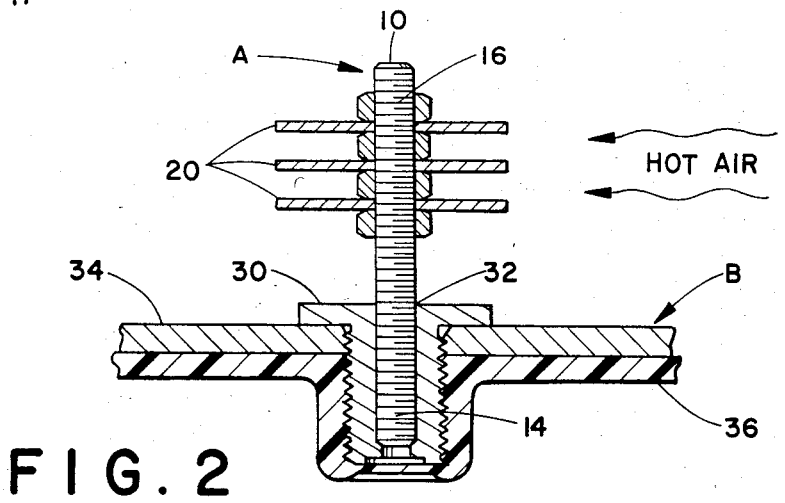
FIG. 2 is a side elevational view, partially in cross section, of the heat pipe assembly of FIG. 1 used with a first section of a rotational mold apparatus.

With reference now to FIG. 2, the heat pipe assembly A may be used in connection with a bung portion B of a rotational molding apparatus. In this connection, the condenser end 14 of the heat pipe 10 may be threaded into a bung 30 via a threaded aperture 32. The bung 30 is secured to a wall member 34 of the rotational molding apparatus. A layer of plastic 36 will extend around the interior of the rotational molding apparatus during the molding operation.

The heat pipe assembly A of the present invention efficiently transfers heat to hard to heat areas of the rotational molding apparatus such as the projection caused by the bung 30. Thus the heat pipe assembly A insures an even heating of the rotational mold apparatus regardless of mold shape or variations in mold wall thickness.

The rotational molding apparatus would normally be placed in an oven (not shown) in order to heat the mold. Because of the projection around the bung 30, the bung portion B of the mold would not get an adequate amount of heat without the heat pipe assembly A of the present invention. With the heat pipe assembly A, however, hot oven air is picked up by the fins 20 and is conducted to the evaporator end 16 of the heat pipe 10. This causes the heat pipe 10 to begin operating and transfer the heat to its condenser end 14 and thus to the plastic 36 surrounding the bung 30 of the rotational molding apparatus.

Since the fins 20 are easily secured to the evaporator end 16 of the heat pipe 10, the degree of heating can be easily controlled through the addition or subtraction of additional fins 20. Thus, the heat pipe assembly A of the present invention enables accurate control of the amount of heating of a particular portion of the rotational molding apparatus.

Figure 3:
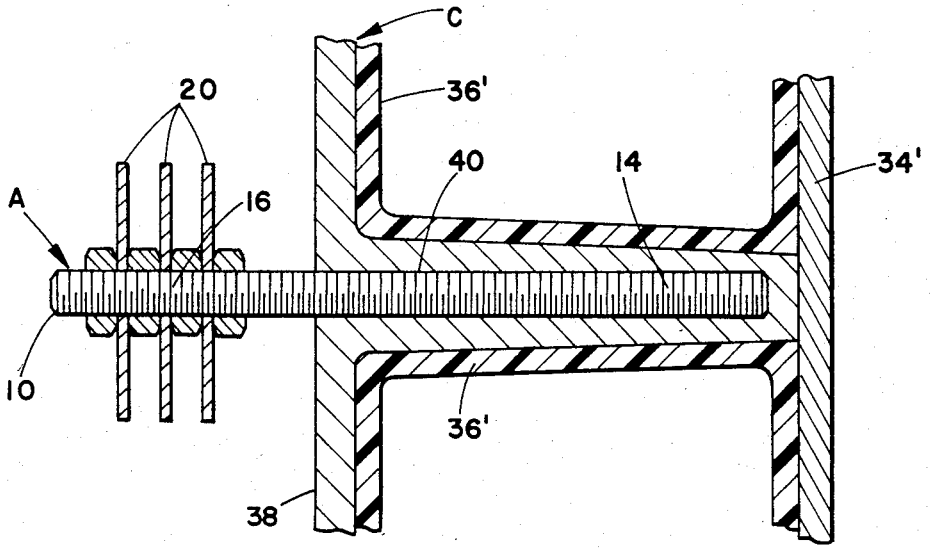
FIG. 3 is a side elevational view, partially in cross section, of the heat pipe assembly of FIG. 1 used with a second section of a rotational mold apparatus.

With reference now to FIG. 3, the heat pipe assembly A of the present invention may also be used to heat a rotational molding apparatus having a standoff support section C. A standoff support member 38 is secured to the mold wall 34' and has a threaded aperture 40 for threadably receiving the condenser end 14 of the heat pipe assembly A. As with the embodiment of FIG. 2, heat will be picked up by the fins 20 and transferred to the evaporator end 16 of the heat pipe 10. The heat pipe 10 will then transfer the heat to its condenser end 14 and by conduction to the standoff support member 38. The heat pipe 10, in this case provides an adequate amount of additional heat to insure that the plastic layer 36' inside the standoff support member 38 receives the same amount of heat as the rest of the plastic layer in the rotational molding apparatus.

Figure 4:
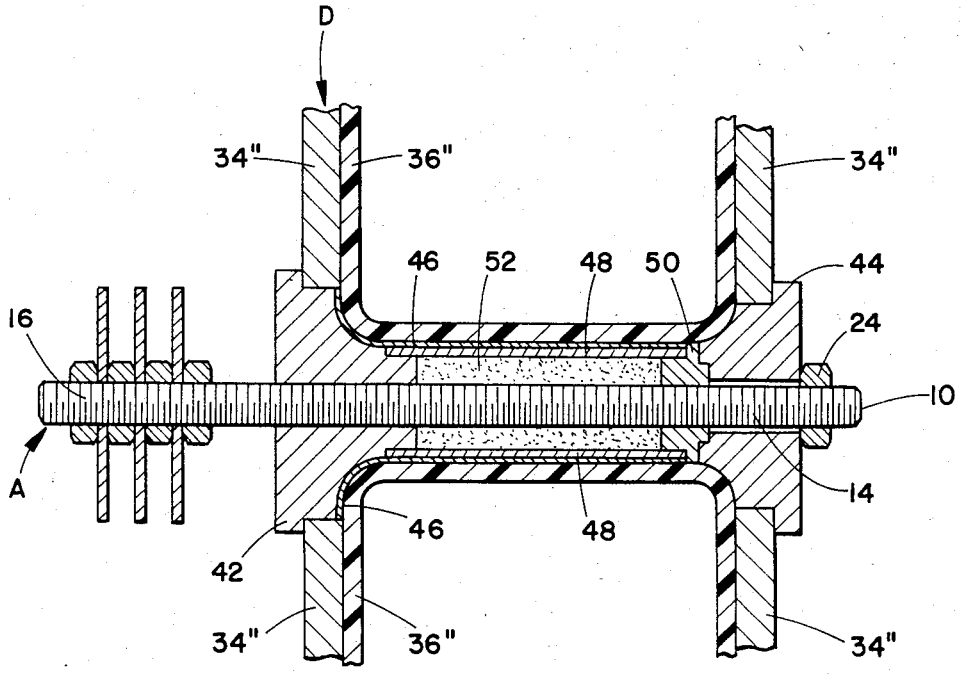
FIG. 4 is a side elevational view, partially in cross section, of the heat pipe assembly of FIG. 1 used with a third section of a rotational mold apparatus.

With reference now to FIG. 4, the heat pipe assembly A of the present invention may also be used in a thru tube section D of a rotational molding apparatus. In one embodiment of such a thru tube section D, the condenser end 14 of the heat pipe 10 is threaded through a first end member 42 and may extend through a second end member 44 of the thru tube section. A locking nut 24 may be used on the far side of the second end member 44 to secure the heat pipe 10 in position. The thru tube also has an aluminum foil layer 46 which surrounds a metal tube 48. The metal tube is received on one end in a tube end unit or bushing 50 and is filled with a heat transfer material 52, such as aluminum shot, and is received on its other end in a radiused section of the first end unit 42. The entire thru tube assembly is held in a pair of wall members 34" of the rotational molding apparatus. As with the embodiment of FIG. 2, the heat pipe 10 receives heat from the fins 20 and provides heat to the plastic layers 36" on each side of the thru tube section D.

When the second locking nut 24 is threaded off the heat pipe 10, the second end member 44 can be removed and the heat pipe with the first end member 42, the bushing 50 and the metal tube can be slid away from the wall members 34" of the rotational molding apparatus. Obviously, this would occur only when the apparatus is not in use and thus there would be no plastic layer 36" in the apparatus. The second end member 44 could also be threaded if it did not have a radiused section so that the entire assembly could still be removed.

To determine the approximate number of fins 20 to be used in a particular roto-mold heating application, the following formula may be used:

$$(V_M+V_{RP})/S \div (A_F-(V_F/S)) = \text{Fin No.}$$

where $V_M$ is the volume of the part of the roto-mold being heated, $V_{RP}$ is the volume of the heat pipe 10, S is the skin thickness of the mold wall, $A_F$ is the effective area of each fin 20 and $V_F$ is the volume of the fin.

The heat pipes 10 may be one-quarter to one and one half inch in diameter and may be two to thirty inches in length. The fins 20 may range in size from two by two inches to four by four inches and are approximately a quarter inch thick. Although square fins 20 are illustrated, obviously circular fins or fins of any other desired shape could also be used. The fins may also be provided with apertures (not illustrated) to enhance the heat transfer process, if desired. Also, the fins do not have to be in alignment with each other but could be angled with respect to each other, if desired. Normally, from four to eighteen fins are used in connection with roto-mold apparatus. Since the fins 20 are a quarter inch thick approximately three fins can be placed along every inch of heat pipe 10 length, considering the width of the intervening nuts 24. Thus, even if eighteen fins 20 are used, they can be placed along six inches of length of, say, a twelve inch heat pipe 10.

Figure 5:
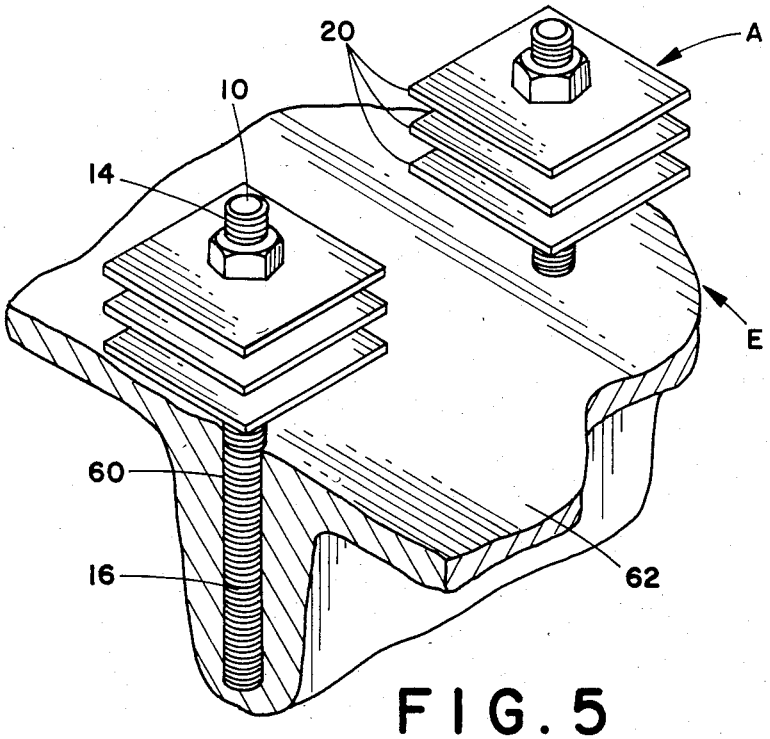
FIG. 5 is a perspective view, in partial cross section, of the heat pipe assembly of FIG. 1 used in an electronic device.

With reference now to FIG. 5, the heat pipe assembly A of the present invention may also be used as a cooling mechanism for an electronic circuit device E. The evaporator end 16 of the heat pipe 10 may be threadably received within a threaded aperture 60 in a base portion 62 of the electronic circuit device E. The heat is transferred from the evaporator end 16 to the condenser end 14 and is dissipated by the the stack of fins 20 carried by the heat pipe 10.

Alternatively, the threaded heat pipe 10 may be used to carry the heat of the electronic device to a cold case (not illustrated). One or more fins 20 can be added on the pipe to accurately control the heat transfer process. Since the heat pipe 10 of the present invention may be easily bolted into place, the need for close tolerances as well as the need to custom design a variety of heat pipes for each specific electronic device is eliminated.

Figure 6:
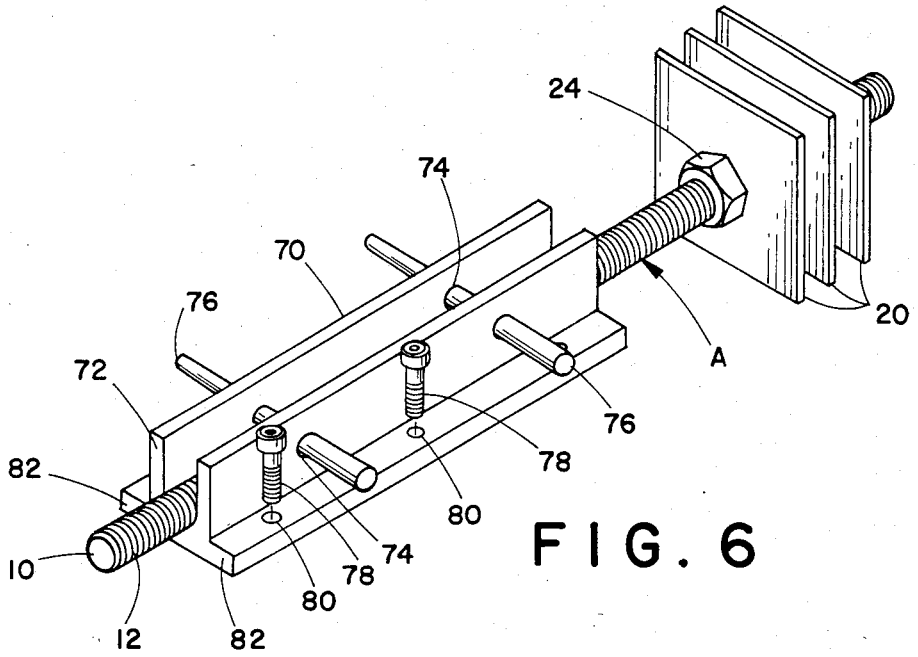
FIG. 6 is a perspective view of the heat pipe of FIG. 1 mounted in a connecting member.
Figure 7:
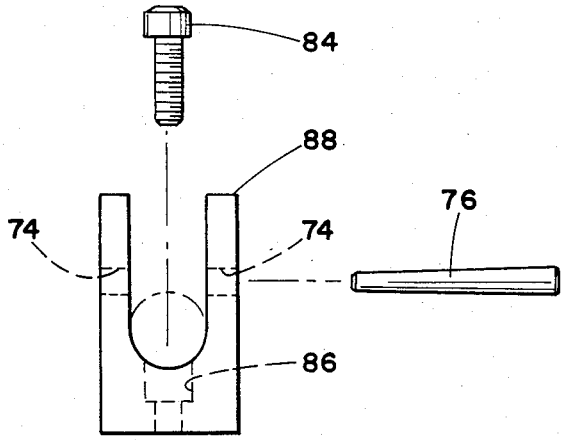
FIG. 7 is an end elevational view of a second preferred embodiment of a connecting member according to the present invention.

With reference now to FIG. 6, another way of attaching the heat pipe assembly A to a body meant to be heated or cooled involves the use of a connecting member 70 in which the heat pipe is secured. The connecting member 70, which is made of a heat conducting material, can have a U-shaped channel 72 in which the heat pipe 10 is fitted. Apertures 74 are provided in the sides of the U for receipt of tapered pins 76 which, when inserted, will prevent the heat pipe 10 from moving. Alternatively, the heat pipe cold be threaded into the connecting member 70, with the connecting member being, for example, a cylinder with a threaded bore extending along its axial length.

The connecting member 70 is secured to the body by first fasteners 78 which extend through apertures 80 provided in a pair of flanges 82 extending from either side at the base of the U-shaped channel 72. The first fasteners 78 may extend into threaded apertures in the device (not illustrated) to selectively secure the connecting member 70 to the device. Alternatively, one or more second fasteners 84 could extend each through its own aperture 86, the apertures being provided in the base of another type of U-shaped connecting member 88. If such a U-shaped member 88 is used, flanges need not be provided. Of course, it would also be possible to permanently attach the connecting member 70, 88 to a body by, for example, welding.

As with the previous embodiments, the heat pipe 10 has a thread 12 and may be provided with one or more heat sink fins 20 secured in place by one or more nuts 24 to enhance the heat transfer process. If the connecting member 70 is secured to a roto-mold, it may be necessary to bend the heat pipe by approximately 90° to move the fins 20 into the air stream.

The heat pipe assembly A of the present invention, which is known as the ROTO-PIN ™ heat pipe 10 with the ADD-A-FIN ™ heat sink fin 20 stack, can transfer heat approximately five thousand times faster than tool steel. The fins 20 of the present invention provide good heat coupling to the air stream passing by the fins.

Although the invention has been shown and described with reference to preferred embodiments, it is obvious that modifications and alterations will occur to others upon a reading and understanding of this specification. It is intended to include all such modifications and alterations insofar as they come within the scope of the appended claims or the equivalents thereof.

What is claimed is:

1. A means for accurately controlling the transfer of heat to or from a device, comprising:

a heat pipe having a condenser end and an evaporator end;

a first securing means for securing the heat pipe to a desired section of the device;

a heat sink means includings a plurality of fins which are each selectively positionable on the heat pipe for selectively controlling the amount of heat transferred between the surrounding environment and said heat pipe; and a second securing means for securing the heat sink means to the heat pipe, wherein the second securing means comprises at least one nut selectively threadable onto a threaded exterior periphery of the heat pipe and wherein at least two nuts are provided, one nut being threaded on either side of each of said fins to secure each fin in position on the heat pipe, and to space each fin from each adjacent fin.

2. The heat transfer means of claim 1 wherein said condenser end of the heat pipe is secured by said securing means to a relatively cool section of the device to heat such section of the device.

3. The heat transfer means of claim 1 wherein said evaporator end of the heat pipe is secured by said securing means to a relatively warm section of the device to cool such section of the device.

4. The heat transfer means of claim 1 wherein a helical screw thread extends along the longitudinal axis of the heat pipe.

5. The heat pipe of claim 1 wherein the first securing means is a U-shaped channel in which a selected portion of the heat pipe can be locked in position, the channel being selectively fixable to said desired section of the device.

6. The heat transfer means of claim 5 wherein the heat pipe is locked in position in the channel by at least one tapered pin which extends through a pair of apertures in the walls of said channel and frictionally holds said heat pipe against movement.

7. The heat pipe of claim 5 wherein said channel is fixed to said desired section of the device by at least one fastener which extends through an aperture in said channel.

8. Heat transfer apparatus for applying heat to a relatively cool section of a device, comprising:

a heat pipe having a condenser end and an evaporator end;

securing means for selectively securing said condenser end of said heat pipe to the device;

a plurality of heat sink fins which are each selectively securable to the evaporator end of the heat pipe via a threaded exterior surface on said heat pipe to control in an accurate manner the amount of heat which is vaporously transported within said heat pipe from the evaporator end to the condenser end thereby accurately controlling the amount of heat received by the device; and, further comprising at least two nuts which are selectively threadable onto the heat pipe via said threading, one nut being threaded on either side of the heat sink fin, to secure the fin in position on the heat pipe.

9. A heat pipe assembly which accurately controls the transfer of heat to or from a device comprising:

a heat pipe having a condenser end and an evaporator end;

securing means for securing said heat pipe to a desired section of an associated device;

means for selectively controlling the amount of heat transferred through said heat pipe, said means including a plurality of fins which are each selectively positionable on said heat pipe;

spacing means for spacing each of said plurality of fins from each adjacent fin on said heat pipe; and, said spacing means including readily detachable locking means for selectively securing said fins on said heat pipe at any time during the life cycle of the assembly and the device to which the assembly is secured to provide accurate control of the amount of heat transferred through said heat pipe by changing the number of fins secured on said heat pipe as necessary, said spacing means being in physical contact with said heat pipe and said fins to also perform a heat transfer function by transferring heat between said heat pipe and said fins, wherein said spacing means comprises at least two nuts which are selectively threadable onto the heat pipe via a helical screw threading provided on an exterior periphery of said heat pipe.

10. The assembly of claim 9 wherein the securing means comprises a helical screw thread provided on the exterior of the heat pipe whereby one of said ends is threaded into a threaded orifice in said associated device.

11. The assembly of claim 9 wherein said fins are positioned approximately transversely to the longitudinal axis of said heat pipe.

12. The assembly of claim 9 wherein said helical screw thread extends along an exterior periphery of said heat pipe from said condenser end to said evaporator end.

13. The assembly of claim 9 whrein said means for accurately controlling enables said heat pipe to transport the desired amount of heat between said associated device and the environment.

14. The assembly of claim 9 wherein said condenser end of said heat pipe is secured by said securing means to a relatively cool section of said associated device to heat such section of said associated device.

15. A means for accurately controlling the transfer of heat to or from a device, comprising:

a heat pipe having a condenser end and an evaporator end;

a first securing means for securing the heat pipe to a desired section of the device;

a heat sink means including a plurality of fins which are each selectively positionable on the heat pipe for selectively controlling the amount of heat transferred between the surrounding environment and said heat pipe; and a second securing means for securing the heat sink means to the heat pipe wherein the first securing means is a helical screw thread which is provided on the exterior of the heat pipe whereby a selected portion of said heat pipe is selectively insertable via said threading into a threaded aperture in said desired section of the device, and wherein said helical screw thread extends the full length of said heat pipe and wherein said second securing means comprises a plurality of nuts, one nut being threaded on either side of each of said plurality of fins to space said fins from each other and secure said fins in position on said heat pipe.

16. A heat pipe assembly which accurately controls the transfer of heat to or from a device comprising:

a heat pipe having a condenser end and an evaporator end;

securing means for securing said heat pipe to a desired section of an associated device;

means for selectively controlling the amount of heat transferred through said heat pipe, said means including a plurality of fins which are each selectively positionable on said heat pipe;

spacing means for spacing each of said plurality of fins from each adjacent fin on said heat pipe; and, said spacing means including readily detachable locking means for selectively securing said fins on said heat pipe at any time during the life cycle of the assembly and the device to which the assembly is secured to provide accurate control of the amount of heat transferred through said heat pipe by changing the number of fins secured on said heat pipe as necessary, said spacing means being in physical contact with said heat pipe and said fins to also perform a heat transfer function by transferring heat between said heat pipe and said fins, wherein said spacing means includes a plurality of bodies each of which has a transverse aperture extending therethrough, said aperture being of a suitable large diameter that said heat pipe can extend longitudinally therethrough and wherein said bodies are nuts and said heat pipe is provided with a helical thread on its exterior surface such that said nuts can be threaded on said heat pipe and wherein said nuts also serve as said readily detachable locking means and enable each fin to be separately secured on said heat pipe.

* * * * *